United States Patent [19]

Funk et al.

[11] 4,347,118

[45] Aug. 31, 1982

[54] SOLVENT EXTRACTION PROCESS FOR TAR SANDS

[75] Inventors: Edward W. Funk; Walter G. May, both of Summit; James C. Pirkle, Jr., Westfield, all of N.J.

[73] Assignee: Exxon Research & Engineering Co., Florham Park, N.J.

[21] Appl. No.: 80,454

[22] Filed: Oct. 1, 1979

[51] Int. Cl.[3] ..... C10G 1/04

[52] U.S. Cl. ..... 208/11 LE

[58] Field of Search ..... 208/11 LE

[56] References Cited

U.S. PATENT DOCUMENTS

| | | | |
|---|---|---|---|
| 2,965,557 | 12/1960 | Price | 208/11 LE |
| 3,475,318 | 10/1969 | Gable et al. | 208/11 LE |
| 4,071,433 | 1/1978 | Hanson | 208/11 LE |
| 4,189,376 | 2/1980 | Mitchell | 208/11 LE |

*Primary Examiner*—Delbert E. Gantz

*Assistant Examiner*—Joseph A. Boska

*Attorney, Agent, or Firm*—James H. Takemoto

[57] ABSTRACT

A solvent extraction process for tar sands is disclosed wherein a low boiling solvent having a normal boiling point of from 20° to 70° C. is used to extract tar sands. The solvent is mixed with tar sands in a dissolution zone, the solvent:bitumen weight ratio being maintained at from about 0.5:1 to 2:1. This mixture is passed to a separation zone in which bitumen and inorganic fines are separated from extracted sand, the separation zone containing a classifier and countercurrent extraction column. The extracted sand is introduced into a first fluid-bed drying zone fluidized by heated solvent vapors, so as to remove unbound solvent from extracted sand while at the same time lowering the water content of the sand to less than about 2 wt. %. The so-treated sand is then passed into a second fluid-bed drying zone fluidized by a heated inert gas to remove bound solvent. Recovered solvent is recycled to the dissolution zone.

8 Claims, 1 Drawing Figure

SCHEMATIC DIAGRAM OF TAR SAND PROCESS

SOLVENT EXTRACTION PROCESS FOR TAR SANDS

BACKGROUND OF THE INVENTION

1. Field of the Invention

This invention relates to a process for the solvent extraction of tar sands. More particularly, a low-boiling hydrocarbon solvent is used in a solvent extraction process in which bitumen and inorganic fines are separated from the extracted sands at a low solvent: bitumen ratio in an extraction zone containing a classifier and countercurrent column and solvent is recovered from the extracted tar sands in successive fluid-bed drying zones.

2. Description of the Prior Art

Among the many approaches considered for separating the petroleum fraction from tar sands, the hot water process represents a well-developed recovery technique. The principal disadvantage of this process is the enormous volume of aqueous tailings. These tailings contain a stable suspension of inorganic fines. Since no economically viable schemes have been devised for removing these suspended fines thus permitting water recycle, the tailings are held in sludge ponds which are both a major expense and an environmental hazard.

Various solvent extraction schemes have been proposed as alternatives to aqueous processes and are attractive because of the ease of separation of tar from sand. On the other hand, such a process must provide for a simple and nearly complete solvent recovery since the solvents are much more expensive than tar sands (present value of the latter is about 0.3¢/lb versus about 16¢/lb for typical solvent).

A solvent extraction process employing aromatic solvents boiling in the range of 82° to 138° C. is disclosed in U.S. Pat. No. 4,139,450 (Hanson et al.). The proces employs a settler followed by a countercurrent extractor but is directed to tar sands other than Athabasca tar sands. Water is removed initially by hot solvent prior to the extraction process. The settler has an overflow of mostly inorganic fines and bitumen and an underflow of coarse solids.

U.S. Pat. No. 4,071,433 (Hanson) describes a liquid slurry process for extracting tar sands in which the tar sands are slurried with an oil and divided in a centrifugal zone into streams containing coarse and fine sands. The fine sand stream is fed to a coker where the fines act as nuclei in coke formation. The coarse sand stream is filtered by means of a hot oil filter and subsequently dried. Similarly, U.S. Pat. No. 4,071,434 (Gifford,II) discloses a process for removing sand from an oil- or water-tar sand slurry wherein the slurry is passed through a centrifugal classifier and divided into fine and coarse sand streams. The coarse sand stream is then subjected to a particle removal step and then fed, together with the fine sand stream, to a coking zone.

The use of a $C_5$ to $C_9$ paraffinic hydrocarbon solvent in a solvent:bitumen ratio of 2 to 1 to 10 to 1 for a countercurrent extraction of tar sands is disclosed in U.S. Pat. No. 4,036,732 (Irani et al.). In this process, the tar sand is first passed to a slurry zone where it is mixed with water containing a small amount of phenol and then to an extraction zone in which a three-phase system must exist. U.S. Pat. No. 3,475,318 (Gable et al.) discloses a process for selectively removing oil from tar sands whereiin a $C_5$ to $C_9$ saturated hydrocarbon or a mixture thereof with a $C_5$ to $C_9$ aromatic hydrocarbon is employed to extract a bed of tar sand deposited on a moving filter. A solvent ratio between 2:1 and 10:1 can be employed.

A solvent extraction process employing a simple countercurrent column is described in U.S. Pat. No. 3,553,099 (Savage et al.). A flowable slurry of tar sand is extracted in a bed by an upwardly flowing toluene wherein fresh toluene is added at 0.25 gal/lb of tar.

U.S. Pat. No. 3,118,741 (Faulk) discloses a process for recovering hydrocarbon solvent from sands such as that obtained from the solvent extraction of bituminous sands. Hot sand is passed through a sloping contact zone together with a gaseous material and then into a separator where gaseous material is withdrawn through the upper portion whereas the solids in the lower portion are maintained in a fluidized condition. Countercurrent extraction of sand with a liquified normally gaseous hydrocarbon and subsequent removal of the hydrocarbon from sand at reduced pressure in a flash drum is described in U.S. Pat. No. 3,131,141 (West).

It would be highly desirable to have a solvent extraction process which would be economically competitive with the hot water process, i.e., provide very high solvent recovery rates, while at the same time eliminating environmental hazard posed by the extensive aqueous tailings produced by the hot water process. The solvent recovery system must have minimal energy and capital requirements and must also avoid emulsion formation which can occur in a system containing surface active solids, water and solvent.

SUMMARY OF THE INVENTION

It has been discovered that an efficient and economical solvent extraction process can be achieved by operating the extraction step at a very low solvent to bitumen ratio and recovering solvent using a two-stage fluid-bed drying zone. Accordingly, the present invention relates to a process for solvent extraction of bitumen from tar sands containing water and inorganic fines and recovering the solvent which comprises mixing the tar sands in a dissolution zone with a solvent having a normal boiling point of from about 20° to 70° C., maintaining the solvent to bitumen weight ratio in the dissolution zone at from about 0.5:1 to 2:1, passing the resultant mixture to a separation zone containing a classifier and countercurrent extraction column, separating the bitumen and inorganic fines from the extracted sand, introducing the extracted sand into a first fluid-bed drying zone fluidized by solvent vapors heated to a temperature effective to remove unbound solvent and lower the sand water content to less than about 2 wt.%, and conducting the so-treated sand to a second fluid-bed drying zone fluidized by an inert gas heated to a temperature effective to remove bound solvent.

Through the use of the present extraction process, it is possible to operate at very low solvent to bitumen ratios while at the same time achieving sufficiently low viscosities to permit facile solid-liquid separations. Low boiling solvents in a low solvent to bitumen ratio do require increased contacting stages in the separation step but this can be achieved in an economical manner by combining a classifier with a countercurrent column.

Moreover, by separating the solvent recovery process into two fluid-bed stages, the total energy requirements are minimized since the majority of solvent and a portion of connate water is recovered in the first drying zone whereas bound, i.e., tightly held solvent is recovered in the second drying zone. This drying scheme is based on the discoveries that a substantial portion of the solvent does not evaporate at its normal boiling point, but at substantially higher temperatures because the solvent is bound by adsorption and emulsification with tar sands, that good fluidization requires lowering the moisture contents of extracted tar sands to less than 2 wt.% and that a small but economically significant amount of solvent is strongly bound to the sand and thus not recoverable in a single stage fluid-bed dryer without excessive energy consumption.

Through the practice of the present process, it is possible to reduce the amount of solvent required to extract tar sands while at the same time minimize the energy requirements to recover solvent and maximize the amount of solvent recovered to at least 99%.

DETAILED DESCRIPTION OF THE INVENTION

Figure 1:
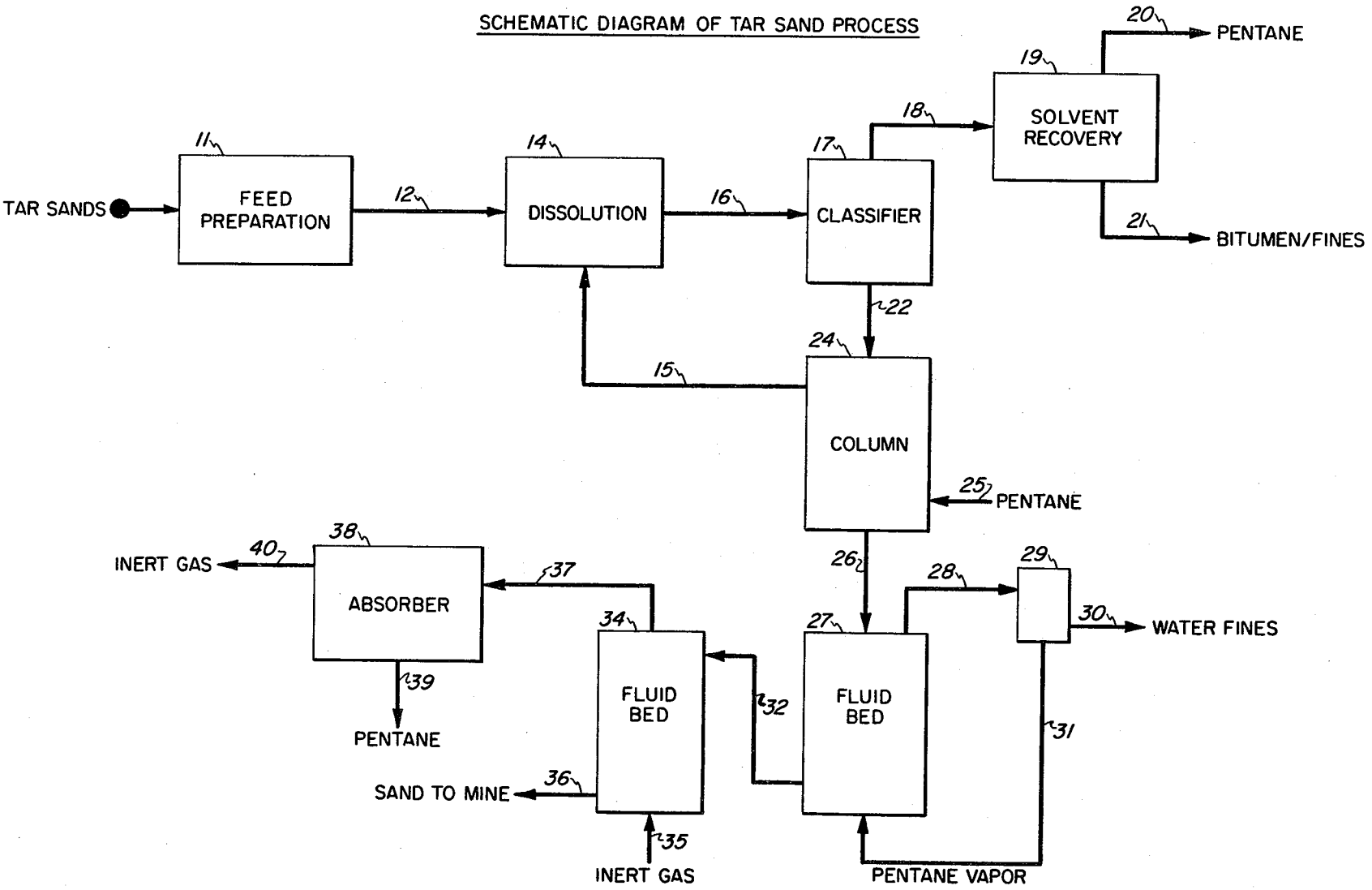
FIG. 1 is a schematic illustration of a preferred embodiment of the invention.

The process of the invention is conveniently understood by reference to FIG. 1 which schematically depicts a preferred embodiment. The description is given for purposes of illustration and is not intended to limit the invention thereto.

In FIG. 1, raw tar sands are prepared in a feed preparation zone 11. Tar sands containing solid aggregates can be broken by crushing or grinding using conventional means into particle sizes suitable for solvent extraction, e.g., 0.01 to 10 mm. The prepared tar sands are then fed through conduit 12 to dissolution zone 14.

Solvent is added to the tar sand in dissolution zone 14 through 15. The ratio of solvent to bitumen in the dissolution zone is maintained preferably at from about 0.5:1 to 1.5:1 and especially at about 1:1. It has been discovered that the viscosity of the solvent/bitumen slurry decreases dramatically up to a solvent:bitumen ratio of 1:1 and that above a ratio of 2:1, little viscosity decrease is observed. Low viscosities are desirable from the standpoint of solid-liquid separations, and sufficiently low viscosities are achieved at a solvent:bitumen ratio of 1:1. A further advantage is that no asphaltenes are precipitated by the present solvents at low solvent:bitumen ratios.

From an economic standpoint, there is little advantage to operating at ratios much above about 1:1. Ratios higher than 2:1 are technically feasible but these larger amounts of solvent represent added recovery costs. This is illustrated in the following table.

TABLE 1

Effect of Pentane/Bitumen Ratio on Process Efficiency

| Pentane/Bitumen | % of Bitumen Energy Required for Solvent Recovery |
|---|---|
| 1 | 0.6 |
| 2 | 1.2 |
| 5 | 3.1 |
| 10 | 6.2 |
| 50 | 31.2 |

Approximately 1:1 ratios permit sufficiently low viscosities for handling, minimize solvent recovery costs, and as will be subsequently discussed, provide enough solvent for nearly complete extraction of bitumen.

While any solvent may in principle be employed in the present process, preferred solvents have low normal boiling points. The higher boiling solvents commonly used in the art, e.g., benzene ($T_b$=80.1° C.) have attractive solvent properties but as noted previously, nearly all common solvents show strong vapor pressure suppression due to various surface phenomena. This results in substantial solvent losses on recovery or uneconomically high recovery temperatures. The present solvents have a preferred boiling point range from about 25° to 60° C. Preferred solvents include $C_5$ to $C_6$ hydrocarbons, e.g., pentane, cyclopentane, 2-methylbutane, 2-methylpentane, 3-methylpentane, 2,2-dimethylbutane; 2,3-dimethylbutane, hexane and mixtures thereof such as 30–60 petroleum ether; carbon disulfide and halogenated $C_1$ to $C_3$ aliphatic compounds such as methylene chloride. Especially preferred solvents are $C_5$ to $C_6$ hydrocarbons or their mixtures, particularly pentane.

The bitumen/pentane slurry is conducted to classifier 17 through conduit 16. The classifiers are those conventionally known in the art such as settlers, thickeners, and hydroseparators. For further details, see Perry, Chemical Engineers' Handbook, McGraw Hill, 4th ed., (1963).

The classifier is used to separate bitumen and inorganic fines from the extracted sands. The bitumen/inorganic fines slurry is removed as an overflow from the classifier through 18 to a solvent recovery zone 19. The solvent, e.g., pentane, is stripped from the bitumen/inorganic fines mixture by conventional means such as flash distillation and is recovered through 20. The bitumen/inorganic fines mixture is fed through 21 to a coker (not shown) for further processing.

In addition to separating inorganic fines and bitumen from extracted sands, the classifier has the further advantage of treating the more viscous mixture. The underflow is fed to countercurrent column 24 through conduit 22. Countercurrent columns are frequently used for liquid-liquid extraction and less frequently for countercurrent solid-liquid extraction. The column may have internal mixing devices such as in an Oldshue-Rushton column or may be essentially a fixed bed, e.g., those used in clay-treating of oils. The solids should be well-distributed across the column to give relatively uniform voidage and thus avoid solvent bypassing of sections of the bed. The selection of classifiers for separation processes is further described in King, *Separation Processes,* McGraw-Hill (1971). Pentane is fed to column 24 through 25. Solvent containing any extracted bitumen is recycled to zone 14 through 15.

The use of a low boiling solvent in a low solvent: bitumen ratio requires a large number of theoretical contacting stages for nearly complete extraction. In the case of pentane/bitumen ratio of 1, 10 contacting stages are required. To provide 10 separate contacting stages would be economically prohibitive. By combining a classifier with a countercurrent column (stages 2–10), the required number of theoretical contacting stages is achieved in a simple and efficient manner. The classifier treats the more viscous material coming from dissolution zone 14 and the viscosity of the mixture entering countercurrent column 24 is lowered in the extraction column to about 1–4 cp which permits good countercurrent flow. While the viscosity entering column 24 is higher than pure solvent, it is nevertheless sufficiently low to minimize fingering effects between the upwardly flowing pure solvent and downwardly flowing mixture from the classifier 17. The mixture of pentane and bitumen is removed through the top of 24 and recycled through 15 to dissolution zone 14.

The extracted sands are then fed through 26 to a first fluid-bed dryer 27. The gases evaporated from the heated fluid-bed include solvent and water, and a small amount of inorganic fines is also carried over through 28 to solvent recovery zone 29. Water and fines are removed through 30 and vaporized solvent is returned to bed 27 through 31. The recovered vaporized solvent is used to fluidize bed 27. In order to achieve good mixing for heat transfer in the first fluid-bed dryer, gas flow rates should be about 3 to 10 times the minimum fluidizing velocity. Generally, gas flow rates from about 10 to 500 cm/sec are suitable.

The broad range of gas flowrates is partially due to the broad range of particle size found within a given tar sand deposit. It is also a reflection of the fact that the present invention can be operated in a variety of fluidization regimes (see Chapter 1 of Davidson and Harrison, *Fluidization,* (1971)) from minimum fluidization up to dilute-phase transport of solids. Chemical engineering calculations, predict drying times per particle of only 1–10 seconds, and thus fluidization regimes which give long residence times are not required.

Drying temperatures in the first fluid-bed drying zone are in the range of about 25° to 60° C. higher than the normal boiling point of the particular solvent employed. This is desirable for at least two reasons. First, it has been observed that good fluidization of extracted tar sands requires moisture contents of less than about 2 wt.%. Since typical tar sands contain about 6 wt.% of water, the moisture content will usually have to be lowered to achieve good fluidization. Second, there is considerable vapor pressure suppression of solvents on sands and clays. For example, in the case of pentane, only about 75% will be vaporized at 36° C., which is the normal boiling point of this solvent. On the other hand, if one attempts to recover all the solvent in a single drying stage, large energy costs are incurred, particularly with the higher boiling solvents commonly employed in the art. For these reasons, the first drying zone is maintained at temperatures of from 50° to 130° C., preferably 60° to 90° C., which temperatures are sufficient to remove unbound, i.e., weakly held solvent, and at the same time lower the water content.

The extracted sands from bed 27 are conducted to a second fluid-bed dryer 34 through 32. This dryer is directed to removing strongly bound solvent. Temperatures of from 25° to 100° C., preferably 30° to 90° C. are suitable. For pentane, a temperature range of from 40° to 60° C. is preferred.

The second bed 34 is fluidized with inert gas such as nitrogen, carbon dioxide, steam or flue gas. Nitrogen is preferred as the inert gas. Flow rates of from 10 to 500 cm/cc are suitable to achieve fluidization. The residence times in the second and first drying zones 34 and 27 are each from about 2 to 200 sec.

Heated inert gas is added through 35 and extracted sand is discharged from the solvent recovery system through 36. Inert gas and vaporized solvent are conducted through 37 to solvent recovery zone 38. Solvent is recycled through 39 and inert gas recycled or discharged through 40.

The present drying system employing multiple fluid-bed dryers gives a virtually complete solvent recovery at minimal energy requirements. The bulk of the solvent is unbound, i.e., weakly held to the sand surface and is removed in the first drying zone while the second drying zone is directed to recovery of bound or strongly held solvent. Even though the amount of solvent recovered in the second drying zone is relatively small, e.g., 1 to 3%, this amount is vital to achieving total recoveries in excess 99%.

Ideally one would like to operate a fluid-bed drying process for solvent recovery from extracted tar sand using the superheated solvent as the fluidizing medium. This would lead to very simple solvent recovery by cooling the superheated vapor and would be the logical operation if the solvent on the tar sand behaved normally and exhibited its normal boiling point. For example, if pentane with a normal boiling point of 36° C. evaporated into pentane vapor at temperatures only slightly above 36° C., it could then be condensed by only small changes in temperature. However, the situation is very different when the vapor pressure of the solvent is suppressed. The fluid-bed dryer fluidized with pentane will only recover that fraction of the solvent which has an effective boiling point below the bed temperature. With a significant fraction of the solvent showing a vapor pressure suppression, the bed temperature would need to be uneconomically high to recover all the solvent in a single fluid bed fluidized with the solvent. Thus, the present process uses the approach of recovering the unbound solvent in the first fluid-bed dryer (which is more energy efficient due to the ease of condensing pentane) and using the second fluid bed, fluidized with inert gas, such as nitrogen, to recover the bound pentane. This bed, with a very low partial pressure of pentane in the vapor phase, effectively strips all the solvent from the tar sands regardless of boiling point, but more extensive cooling is required to condense the pentane from the dilute stream of inert gas/-pentane.

The process of the invention is further illustrated in the following examples.

EXAMPLES

EXAMPLE 1

The dependence of viscosities of pentane/bitumen solutions as a function of the pentane:bitumen ratio is illustrated in this example. Tar sands of known bitumen content were extracted with varying amounts of pentane and the viscosities of the resulting solutions were determined on a Ubbelohde viscometer according to the procedure given in ASTM-445 at a temperature of 25° C. The results are described in the following table:

TABLE 2

Viscosities of Pentane/Bitumen Solutions

| Pentane/Bitumen (Weight Ratio) | Viscosity, Centipoise |
|---|---|
| 0 | 30,000 |
| 0.2 | 300 |
| 0.5 | 18 |
| 1.0 | 3 |
| 2.0 | 0.9 |
| 3.0 | 0.6 |
| 4.0 | 0.3 |

These data demonstrate that a sharp decrease in the bitumen/pentane solution viscosity occurs up to a ratio of about 1:1. Above 1:1, there is very little decrease in viscosity. As one decreases the pentane/bitumen ratio below 1:1, the rapidly increasing viscosity will make solid-liquid separations increasingly difficult. On the other hand, ratios above 1:1 provide little benefit in terms of viscosity decrease while significantly increasing energy requirements for recovering solvent.

Other solvents such as benzene, toluene, xylene, carbon disulfide and methylene chloride show very similar viscosity behavior with Athabasca bitumen. These results emphasize the advantages of operating the solvent extraction process at a solvent/bitumen ratio of about 1:1.

EXAMPLE 2

This example was conducted to demonstrate that bitumen can be efficiently extracted from tar sands using paraffinic solvents and a countercurrent column. Athabasca tar sands from Mildred Lake were extracted using heptane as the solvent. For extraction purposes, pentane, hexane and heptane behave in a similar manner and heptane was chosen for safety reasons. The countercurrent column was 5.08 cm in diameter, 180 cm in length and contained a central shaft with impellers for stirring. The feed system was an auger screw and could meter tar sands at from 20 to 100 lbs/hr. The superficial flow rate of heptane in the column was 0.3 to 0.9 cm/sec. The tar sands were first batch extracted to remove from 10 to 80% of the bitumen before countercurrent extraction with heptane. This is equivalent in effect to treatment with a conventional classifier. The partially extracted sands were then fed to the countercurrent column and continuously extracted. The total amount of bitumen extracted in this manner was from about 96% to 99%.

As discussed above, a countercurrent extractor can be effectively used to extract a very high percentage of bitumen from tar sands. When combined with a classifier in which an initial extraction of tar sands occurs, bitumen recoveries of 95% to 99% are attainable. The classifier, e.g., a Dorr-Oliver type thickener, treats the initial mixture of tar sand and solvent and removes most of the inorganic fines and a substantial portion of the bitumen as overflow, thus permitting the countercurrent extractor to function more efficiently on the underflow of partially extracted sand.

EXAMPLE 3

This example illustrates the vapor pressure suppression of solvents in contact with tar sands. Tar sands from Mildred Lake were extracted, the extracted sands containing 15 wt.% of residual pentane. The sands were heated and a determination was made of the amount of pentane evaporated as a function of temperature. The results are summarized in the following table.

TABLE 3

Vapor Pressure Suppression in the Pentane/Tar Sand System

| T°C. | % Pentane Evaporated |
|---|---|
| 36.0 | 75.0 |
| 60.0 | 87.7 |
| 80.0 | 91.0 |
| 90.0 | 94.0 |
| 95.0 | 97.6 |
| 97.0 | 98.5 |
| 101.0 | 99.5 |

As can be seen from the data, a temperature of 101° C. is required to recover more than 99% of the pentane. This is some 65° C. higher than the normal boiling point of pentane, i.e., 36° C. If there were no solvent interaction with the sand, all the solvent would be expected to evaporate at its normal boiling point. This substantial vapor pressure suppression is evidence of strong surface-solvent interactions, e.g., adsorption and emulsion formation.

A typical aromatic solvent such as toluene which has a normal boiling point of 110° C. would likely require a fluid-bed dryer operating in the range of 250°-300° C. in order to recover 99% solvent. These temperatures, however, are uneconomical due to energy requirements to attain high operating temperatures and heat losses with vapor and discarded sand.

EXAMPLE 4

This example is directed to a study of the fluidization of extracted tar sands which are wet with pentane. In a preliminary study, pentane-wet sand equal to 20 wt.% of the fluid-bed was added to a batch fluid-bed dryer. The bed was fluidized with nitrogen gas at 60° C., and a gas velocity of from 1.1 to 6.0 times the minimum fluidization velocity. The wet sand did not fluidize but rather tended to stick together and sink through the bed, i.e., it behaved as a coherent mass similar to the behavior of wet beach sand. While a substantial portion (>10%) of pentane could not be evaporated at 60° C., this alone would not account for the resistance of the sand to fluidization.

The extracted sands wet with pentane were then contacted with superheated pentane gas at 60° C. at a flow rate of about 80 cm/sec which is sufficient for fluidization. By monitoring the water content of the extracted sands, it was discovered that fluidization occurred when at least about 70-95% of the connate water had been removed; thus efficient fluid-bed drying requires that the connate water content of a typical tar sands be lowered to less than 2 wt.% in order to achieve effective fluidization.

EXAMPLE 5

The advantages of a second fluid-bed which is fluidized with an inert gas such as nitrogen is shown in this example. Tar sands which have been extracted with pentane are fed to a fluid-bed dryer. The bed is fluidized with nitrogen at flow rates of from 18 to 120 cm/sec. at varying temperatures. The table below presents drying data in which the time required to remove at least 99% of pentane from the extracted sands is measured as a function of temperature.

TABLE 4

Pentane Recovery from Tar Sands Using Nitrogen

| Run | T°C. | Time, Seconds |
|---|---|---|
| 1 | 50 | 450.0 |
| 2 | 60 | 300.0 |
| 3 | 80 | 200.0 |
| 4 | 120 | 140.0 |

The data demonstrate that even though some solvent is strongly bound through adsorption to sand, it can be efficiently stripped by heated nitrogen gas in a short period of time. Since only a relatively small amount of nitrogen is required to increase the pentane recovery to >99%, this minimizes separation costs in recycling both solvent and gas.

By combining a first and second fluid-bed dryer in series, it is possible to achieve nearly complete solvent recovery at minimal energy costs. The first fluid-bed dryer using heated solvent vapor removes the unbound solvent, i.e., that solvent which is only weakly held on the sand surface, and also lowers the water content of the sand to a value whereby efficient fluidization is achieved. The second dryer using heated inert gas rapidly removes the remaining bound, i.e., tightly held solvent while at the same time minimizing energy and separation costs.

What is claimed is:

1. A process for solvent extraction of bitumen from tar sands containing water and inorganic fines and recovering the solvent which comprises mixing the tar sands in a dissolution zone with $C_5$ to $C_6$ hydrocarbon solvent having a normal boiling point of from about 25° to 60° C.;

maintaining the solvent to bitumen weight ratio in the dissolution zone at from about 0.5:1 to 1.5:1;

passing the resultant mixture to a classifier wherein an overflow of a viscous mixture of bitumen and inorganic fines is separated from an underflow of extracted sand, then passing the underflow of extracted sand through a countercurrent extraction column wherein the sand is further extracted;

introducing the extracted sand into a first fluid-bed drying zone fluidized by $C_5$ to $C_6$ hydrocarbon solvent vapors and heated to a drying temperature which is about 25° to 60° C. higher than the normal boiling point of said $C_5$ to $C_6$ hydrocarbon solvent, wherein unbound solvent is removed from extracted sand and the sand water content is lowered to less than about 2 wt.%; and conducting the so-treated sand to a second fluid-bed drying zone fluidized by inert gas heated to a temperature of from 25° to 100° C. wherein bound solvent is removed.

2. The process of claim 1 wherein the solvent is pentane.

3. The process of claim 2 wherein the pentane to bitumen ratio is about 1:1.

4. The process of claim 1 wherein the second fluid-bed drying zone is fluidized with an inert gas selected from the group consisting of nitrogen, carbon dioxide, steam or flue gas.

5. The process of claim 1 wherein the inert gas is nitrogen.

6. The process of claim 1 wherein the flow rate of solvent vapor is from 10 to 500 cm/sec.

7. The process of claim 1 wherein flow rate of inert gas is from 10 to 500 cm/sec.

8. The process of claim 1 wherein extract is recycled to the dissolution zone.

* * * * *